United States Patent [19]

Luzynski

[11] 4,305,038

[45] Dec. 8, 1981

[54] IGNITION CIRCUIT TESTER

[76] Inventor: Anthony J. Luzynski, 3526 Sheffield Ave., Philadelphia, Pa. 19136

[21] Appl. No.: 115,921

[22] Filed: Jan. 28, 1980

[51] Int. Cl.[3] ..... F02P 17/00

[52] U.S. Cl. ..... 324/402; 324/384; 324/390

[58] Field of Search ..... 324/402, 378, 390, 384

[56] References Cited

U.S. PATENT DOCUMENTS

| | | | |
|---|---|---|---|
| 2,645,751 | 7/1953 | Byerlay | 324/402 X |
| 2,701,335 | 2/1955 | Sargeant et al. | 324/402 |
| 3,452,270 | 6/1969 | Cook | 324/402 X |
| 3,603,872 | 9/1971 | Pelta | 324/402 X |
| 3,617,870 | 11/1971 | Howes | 324/402 |
| 3,961,240 | 6/1976 | Pohl | 324/402 X |

*Primary Examiner*—Stanley T. Krawczewicz
*Attorney, Agent, or Firm*—Robert K. Youtie

[57] ABSTRACT

An ignition circuit tester including a pick-up coil assembly for inductive coupling with and location closely along a circuit element to be tested, an amplifier circuit for amplifying a signal picked up by the coil assembly, and a meter to indicate the signal.

7 Claims, 3 Drawing Figures

IGNITION CIRCUIT TESTER

BACKGROUND OF THE INVENTION

As is well known to those versed in the automotive service field, location of an ignition circuit defect is often tedious and time consuming, usually requiring disconnection and reconnection of parts which often results in damage, or removal and replacement of parts which may be expensive without remedying the problem.

While there are a number of prior art ignition circuit tester devices, such devices have not been found satisfactory and generally leave the practitioner to cope with the above-described difficulties. Applicant is aware of the below listed prior U.S. Pat. Nos.

2,701,335 Sargeant et al
3,452,270 Cook
3,603,872 Pelta
3,743,922 Festos
3,763,421 Glomski
3,811,089 Strzelewicz

SUMMARY OF THE INVENTION

Accordingly, it is an important object of the present invention to provide an ignition circuit tester for use with automotive and similar electric ignition type internal combustion engines, which enables a mechanic to simply, quickly, and easily manipulate a pick-up assembly or probe to selectively locate the probe along an element to be tested and observe the quality of the element by a corresponding meter reading.

More specifically, it is an object of the present invention to provide an ignition circuit tester wherein a coil assembly is adapted to be carried on the end of an elongate member or handle for convenient manual location in inductive coupling with a selected spark plug, ignition wire, distributor or corresponding part of an electronic ignition circuit, all without disconnection, removal, replacement, or other handling of ignition circuit elements, to effectively overcome the above-mentioned difficulties of the prior art.

Other objects of the present invention will become apparent upon reading the following specification and referring to the accompanying drawings, which form a material part of this disclosure.

The invention accordingly consists in the features of construction, combination of elements, and arrangements of parts, which will be exemplified in the construction hereinafter described, and of which the scope will be indicated by the appended claims.

DESCRIPTION OF THE PREFERRED EMBODIMENT

Figure 1:
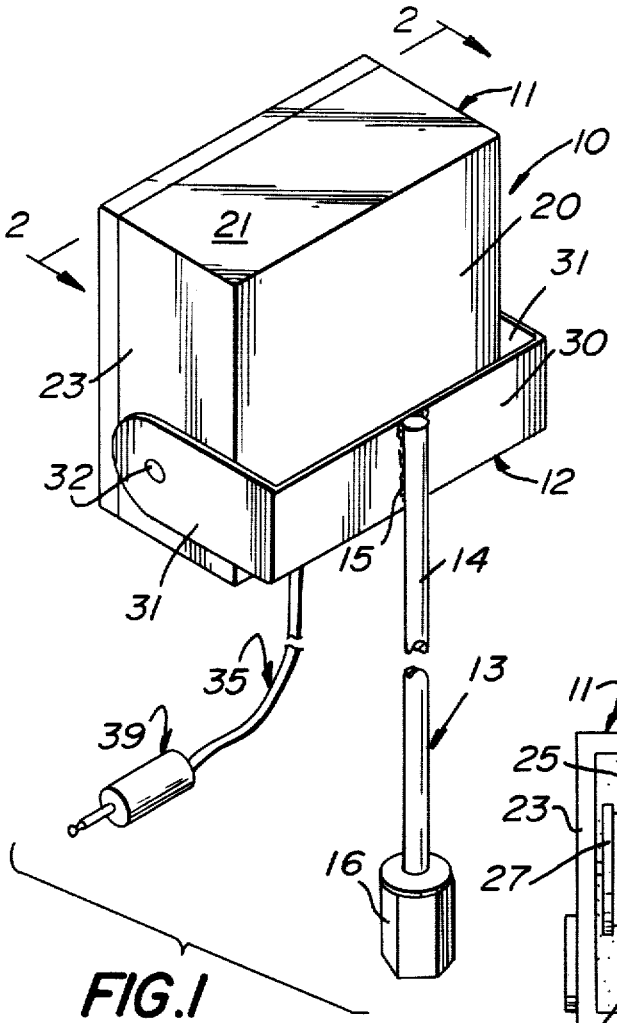
FIG. 1 is a rear prospective view showing a pick-up assembly of the present invention, broken away to conserve drawing space.
Figure 2:
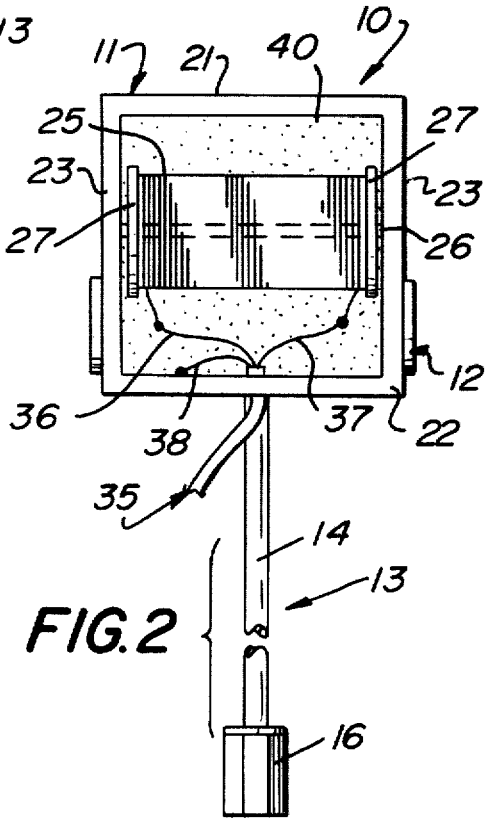
FIG. 2 is a front view of the assembly of FIG. 1.

Referring now more particularly to the drawings, and specifically to FIGS. 1 and 2 thereof, a pick-up or coil assembly is there generally designated 10, and may include a coil housing 11 carried by a straddling yoke 12. An elongate member or handle 13 includes a rod 14 having one end suitably fixed, as by welding 15 to the yoke or carrier 12, and the other end of rod 14 may be provided with a hand piece 16 for manual grasping by the user.

The housing 11 may be in the form of an enclosure, say of box-like configuration, having one side open, and fabricated of conductive, electronically shielding material, such as aluminum. Specifically, the housing 11 may include a generally rectangular rear wall or back 20, top and bottom walls 21 and 22 extending forwardly from upper and lower edges of the back wall 20, and opposite side walls 23 extending forwardly from opposite side edges of the back wall and between the top and bottom walls. The front of the rectangular or box-like enclosure or housing 11 may be open, as by the absence of a front wall.

Internally within the hollow or concavity of the housing 11 there is suitably mounted a helical coil 25 of conductive filament or wire having a suitable number of convolutions, 4500 turns of 149 ohm #38AWG magnet wire having been found satisfactory. The coil 25 is carried by a rod or core 26 extending between side walls 23, and end pieces or discs 27 are circumposed about the rod 26 at opposite ends of the coil 25, so that the rod 26 and ends 27 define a spool for the coil. Thus, the axis of the coil 25 extends laterally with respect to the housing 11, between opposite housing side walls 23.

The carrier or yoke 12 may be of generally U-shaped configuration, including an intermediate portion extending laterally across and rearward of the rear housing wall 20, and a pair of generally forwardly extending legs 31 projecting in general parallelism from opposite ends of the intermediate portion 30. The forward ends of the legs 31 terminate adjacent to and outward of respective housing side walls 23 and may be pivotally connected thereto, as by appropriate pivot means 32.

An electric wire or cord 35 may be of two-conductor shielded wire, extending from interiorly of the housing 11, having two conductors 36 and 37 respectively connected to opposite ends of coil 25, and the shield conductor 38 connected to the housing 11. The shielded conductor 38 may extend externally of the housing to terminate in a suitable connector or plug 39.

In practice, the coil 25 is preferably potted, or imbedded in potting material, such as transparent epoxy 40, which may substantially completely fill the interior of the housing 11. The potting material is of insulating characteristic, so as not to adversely affect a magnetic field being sensed, and effectively protects the coil from damage.

Figure 3:
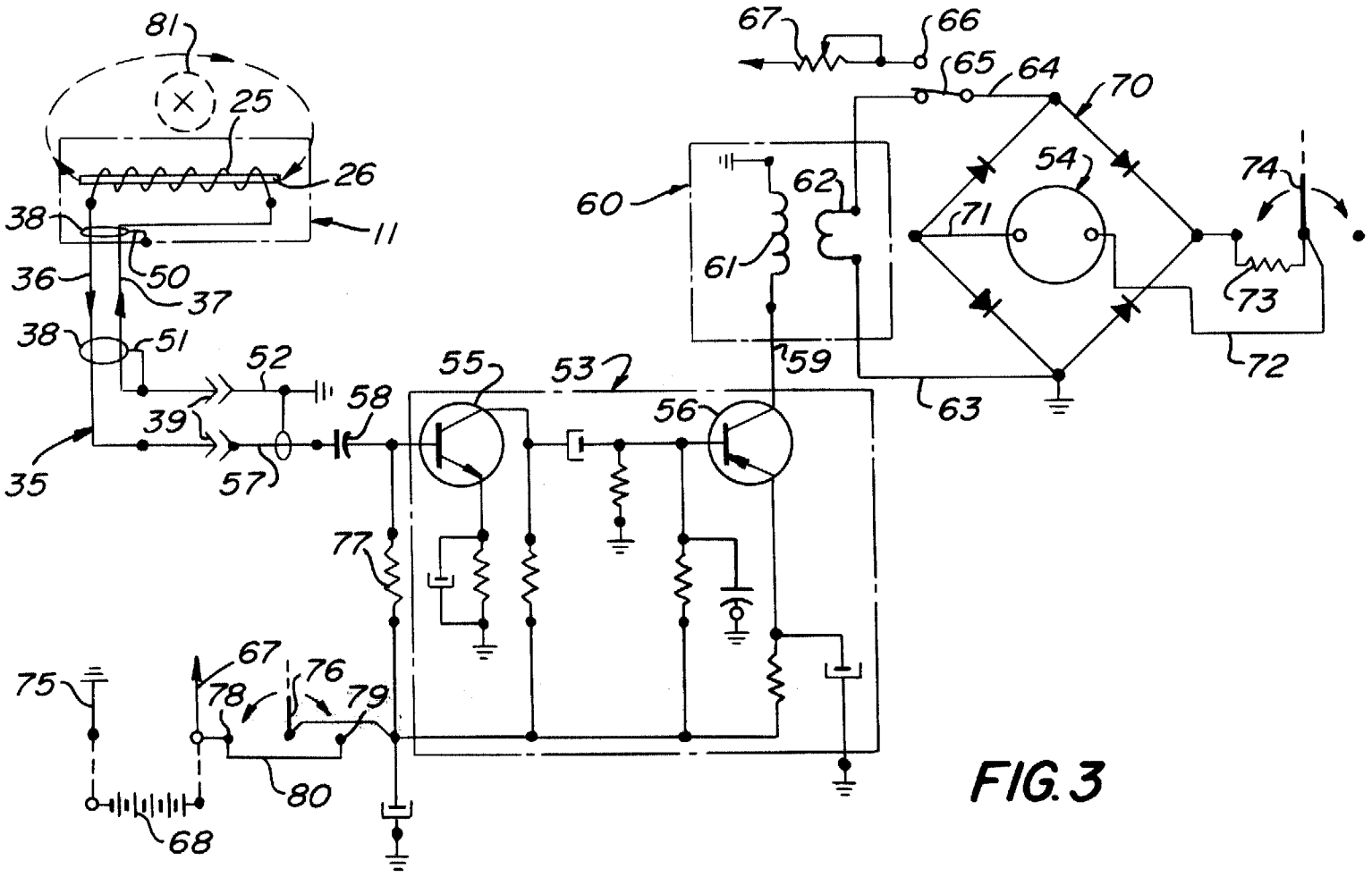
FIG. 3 is a schematic representation of the electrical circuitry of the present invention.

Considering now the circuitry of FIG. 3, the pick-up coil assembly includes the coil 25 on its core 26 and connected at its opposite ends to conductors 36 and 37, which are provided with a shield 38 connected interiorly of the housing 11 to the latter, as at 50, and connected adjacent to the plug 39, as at 51, to conductor 37. The conductor 37 is connected to ground, in the operative condition, as through conductor 52.

Through the cord 35, containing conductors 36 and 37, the coil 25 is connected to feed amplifier means 53, the output of which is fed to an indicating means or meter 54.

More specifically, the amplifier means 53 includes a plural stage transistor amplifier, including a pair of resistance coupled transistors, as at 55 and 56. The coil conductor 36 may feed through plug 39, shielded conductor 57, and filtering compacitor 58 to the base of n-p-n type transistor 55. The emitter of transistor 55 is biased to ground, and the collector of transistor 55 is resistance coupled to feed the base of p-n-p transistor 56. From the collector of transistor 56, an output conductor 59 feeds a transformer 60.

Specifically, the output conductor 59 of transistor amplifier means 53 is connected to the primary winding 61 of transformer 60, and the secondary winding 62 of the transformer is connected by conductor 63 and 64 to opposite sides of a rectifying bridge 70. A push-button switch 65 may be connected in conductor 64, being normally closed in the latter conductor, and depressible to connect the meter 54 on one side to a contact 66 connected through a rheostat 67 to the positive terminal of a battery 68.

The meter 54 is connected on one side to one bridge junction, as by conductor 71, and is connected on its other side by a conductor 72, and through resistor 73 to the opposite junction of bridge 70. A switch 74 is swingable to selectively bypass the resistor 73 to effectively change the calibration of meter 54, for purposes which will presently become apparent.

The battery 68 supplies power to the circuitry, having one side grounded, as at 75, and having its other side connected through a switch 76 to the input of two stage transistor amplifier 53, as through coupling resistor 77. The switch arm 76 is selectively swingable to contact 78 directly connected to the battery 68, and a contact 79 connected through a conductor 80 to the battery. The switch arms 76 and 74 may be combined as a single switch, as a two pole double throw switch.

In operation, the quality of the battery 68 may be tested by closing switch 65 to contact 66, which will place the battery across the meter 54. With the potentiometer 67 properly calibrated, a good battery may read full scale on the meter.

In testing ignition wires and spark plugs, the switch arms 74 and 76 may be swung leftward to, respectively, bypass the resistor 73 and engage the arm 76 with contact 78 for connecting power to the circuit. It is then necessary to locate the coil 25 along the several wires, with the coil axis extending transverse of the wire, such as a wire 81 shown in FIG. 3, to lie in the magnetic field of the wire with the coil inductively coupled with the magnetic field. A properly operating ignition wire with the probe or pick-up 10 located as described, will produce a known reading on meter 54. Similarly, the pick-up is successively located along and similarly in inductively coupled relation with the several spark plugs. Here also, properly operating spark plugs will produce a known reading at meter 54. Of course, inoperative ignition wires or plugs will be identified by the absence of the correct meter reading.

In testing the distributor, as higher voltage and stronger electromagnetic field is there produced, the switch arms 74 and 76 are swung rightward to, respectively, place the resistor 73 in series with the meter 54 and close arm 76 to contact 79 for connecting power to amplifier 53 through conductor 80 to battery 68. The pick-up assembly 10 is then located in inductively coupled relation with the distributor, to ascertain whether a predetermined signal is generated in the coil by observing the meter 54. That is, the meter 54, including the resistor 73, is known to produce a predetermined indication responsive to a properly operating distributor. This is also true when the testing device is used in association with the newer electronic or high energy ignition systems.

From the foregoing, it is seen that the present invention provides an ignition circuit testing apparatus which is extremely simple in construction, durable and reliable throughout a long useful life, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. An ignition circuit tester comprising a pick-up coil assembly selectively locatable along an element to be tested for indirect coupling thereto and generation of a signal in the pick-up coil assembly corresponding to the signal in the element tested, amplifier means connected to the pick-up coil assembly for amplifying the generated signal, and a meter connected to the amplifier means output affording a visual indication corresponding to the generated signal, said pick-up coil assembly comprising a conductive housing having one side open, a coil proper located in said housing with its axis straight and extending along said open side of said housing, and non-conductive material embedding said coil proper in said housing to protect the coil proper without effectively detracting from the inductive coupling, said housing being grounded to effectively shield said coil except from the open housing side.

2. An ignition circuit tester according to claim 1, said amplifier means comprising transistor amplifier means having its input resistance coupled to said pick-up coil assembly and its output transformer coupled to said meter.

3. An ignition circuit tester according to claim 2, said amplifier means comprising plural stage amplifier means having resistance inter-stage coupling.

4. An ignition circuit tester according to claim 1, in combination with impedance means selectively connected in circuit with said meter corresponding to pick-up coupling with a spark plug or distributor.

5. An ignition circuit according to claim 4, in combination with a power switch electrically connected between said power supply and said amplifier means, said power switch being associated with said impedance means to close when said impedance means is electrically connected in circuit with said meter corresponding to pick-up coupling with a spark plug or distributor.

6. An ignition circuit tester according to claim 1, in combination with a power switch connected to said amplifier means for selectively connecting the latter to a power supply, and a test circuit connected to said meter for selectively connecting said meter to a power supply to test the latter.

7. An ignition circuit tester according to claim 1, in combination with a handle yoke astride of and pivotally connected to said housing on the side opposite to said open side, for free swinging accomodation closely along a wire being tested.

* * * * *